US009362681B2

(12) United States Patent
Yu et al.

(10) Patent No.: US 9,362,681 B2
(45) Date of Patent: Jun. 7, 2016

(54) ELECTRICAL CONNECTOR WITH SHIELDING PLATE SECURED THEREIN

(71) Applicant: FOXCONN INTERCONNECT TECHNOLOGY LIMITED, Grand Cayman (KY)

(72) Inventors: Chun-Ming Yu, Kunshan (CN); Bao-Feng Lu, Kunshan (CN); Xiao-Qin Zheng, Kunshan (CN); Qi-Sheng Zheng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/616,731

(22) Filed: Feb. 8, 2015

(65) Prior Publication Data

US 2015/0229082 A1 Aug. 13, 2015

(30) Foreign Application Priority Data

Feb. 7, 2014 (CN) ..... 2014 2 0058639 U

(51) Int. Cl.
*H01R 13/648* (2006.01)
*H01R 13/6587* (2011.01)

(52) U.S. Cl.
CPC ..... *H01R 13/6587* (2013.01)

(58) Field of Classification Search
CPC ..... H01R 13/6587
USPC ..... 439/607.09, 607.4, 607.08, 660
See application file for complete search history.

(56) References Cited

U.S. PATENT DOCUMENTS

| | | | | |
|---|---|---|---|---|
| 7,173,127 | B2 * | 2/2007 | Born | C07D 201/12 540/540 |
| 7,559,805 | B1 * | 7/2009 | Yi | H01R 13/6658 439/660 |
| 8,251,746 | B2 * | 8/2012 | Zhang | H01R 13/6581 439/607.11 |
| 8,388,372 | B2 * | 3/2013 | He | H01R 27/02 439/101 |
| 8,419,474 | B2 * | 4/2013 | Zhang | G02B 6/3817 439/607.25 |

FOREIGN PATENT DOCUMENTS

CN 102315560 A 1/2012

* cited by examiner

*Primary Examiner* — Phuong Dinh
(74) *Attorney, Agent, or Firm* — Wei Te Chung; Ming Chieh Chang

(57) ABSTRACT

An electrical connector includes a first terminal module, a second terminal module, a shielding shell and a metallic shielding plate. The first terminal module includes a first mating tongue and first terminals insert molded thereamong. The first mating tongue has a first mating face on which the first terminals are exposed. The first terminals have first connecting sections extending in a vertical direction. The second terminal module includes a second mating tongue and second terminals insert molded thereamong. The second mating tongue has a second mating face directly facing to the first mating face and a third mating face. The second terminals are disposed in the second and third mating faces and have second connecting sections extending in the vertical direction. The metallic shielding plate is disposed between the first and second connecting sections and has a plurality of hooked shrapnels elastically contacting with the shielding shell.

14 Claims, 9 Drawing Sheets

ELECTRICAL CONNECTOR WITH SHIELDING PLATE SECURED THEREIN

BACKGROUND OF THE INVENTION

1. Field of the Invention

The present invention generally relates to an electrical connector, and more particularly to an electrical connector provided with a metallic shielding plate secured therein.

2. Description of Related Art

Chinese patent No. 102315560 discloses a stacked electrical connector. The electrical connector comprises an insulating housing, a plurality of conductive terminals secured in the insulating housing, an insulating base used for retaining the conductive terminals and a shielding shell surrounding the insulating housing. The insulating housing has a base portion and two mating tongues extending forwardly from the base portion and being parallel with each other. The conductive terminals have two groups of terminals separately disposed in the two aforementioned mating tongues. The two groups of conductive terminals have four rows of connecting portions located behind the insulating housing. The four rows of connecting portions are closed to each other because the electrical connector is becoming smaller and smaller. In order to reduce the interference between the two groups of conductive terminals, a metallic shielding plate is provided to be disposed between the two groups of terminals. Due to the connecting portions of the conductive terminals are set as four rows with a metallic shell disposed therebetween, the production reject ratio increases, thereby increasing a production cost.

In view of the foregoing, an electrical connector with a metallic shielding plate is able to overcome the drawbacks described aforementioned would be desirable.

SUMMARY OF THE INVENTION

Accordingly, an object of the present invention is to provide an electrical connector, the electrical connector has a metallic shielding plate secured therein.

In order to achieve the object set forth, an electrical connector is provided with a first terminal module, a second terminal module assembled with the first terminal module, a shielding shell surrounding the first and second terminal modules and a metallic shielding plate fixed thereamong. The first terminal module comprises a first mating tongue and a plurality of first terminals insert molded thereamong. The first mating tongue has a first mating face in which the first terminals being exposed. The first terminals have first connecting sections extending in a vertical direction and being disposed in one row along a longitudinal direction perpendicular to the vertical direction. The second terminal module comprises a second mating tongue and a plurality of second terminals insert molded thereamong. The second mating tongue has a second mating face directly facing to the first mating face and a third mating face opposite to the second mating face. The second terminals are disposed in the second and third mating faces and have second connecting sections extending in the vertical direction. The shielding shell surrounds the first and second terminal modules to form a mating cavity opening forwardly into which the first and second mating tongues extending forwardly. The metallic shielding plate is disposed between the first and second connecting sections and has a plurality of hooked shrapnels elastically contacting with the shielding shell. The second terminal module has a base portion from which the second mating tongue extending forwardly. The base portion has a supporting wall in a rear side thereof along the vertical direction on which the metallic shielding plate is attached.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention. FIG. 1 to FIG. 8 are taken to describe an electrical connector 100 provided with an insulating housing 1, a plurality of conductive terminals 2 secured in the insulating housing 1 and a metallic shielding shell 3 surrounding the insulating housing 1. The electrical connector 100 has a mating interface same as a USB 3.1 B Type connector standard which has a transmission rate of 10 G (USB-IF published a USB 3.1 interface specification). The electrical connector 100 may mate with a USB 2.0 B type plug, a USB 3.0 B type plug or a USB 3.1 B type plug at one time.

Figure 3:
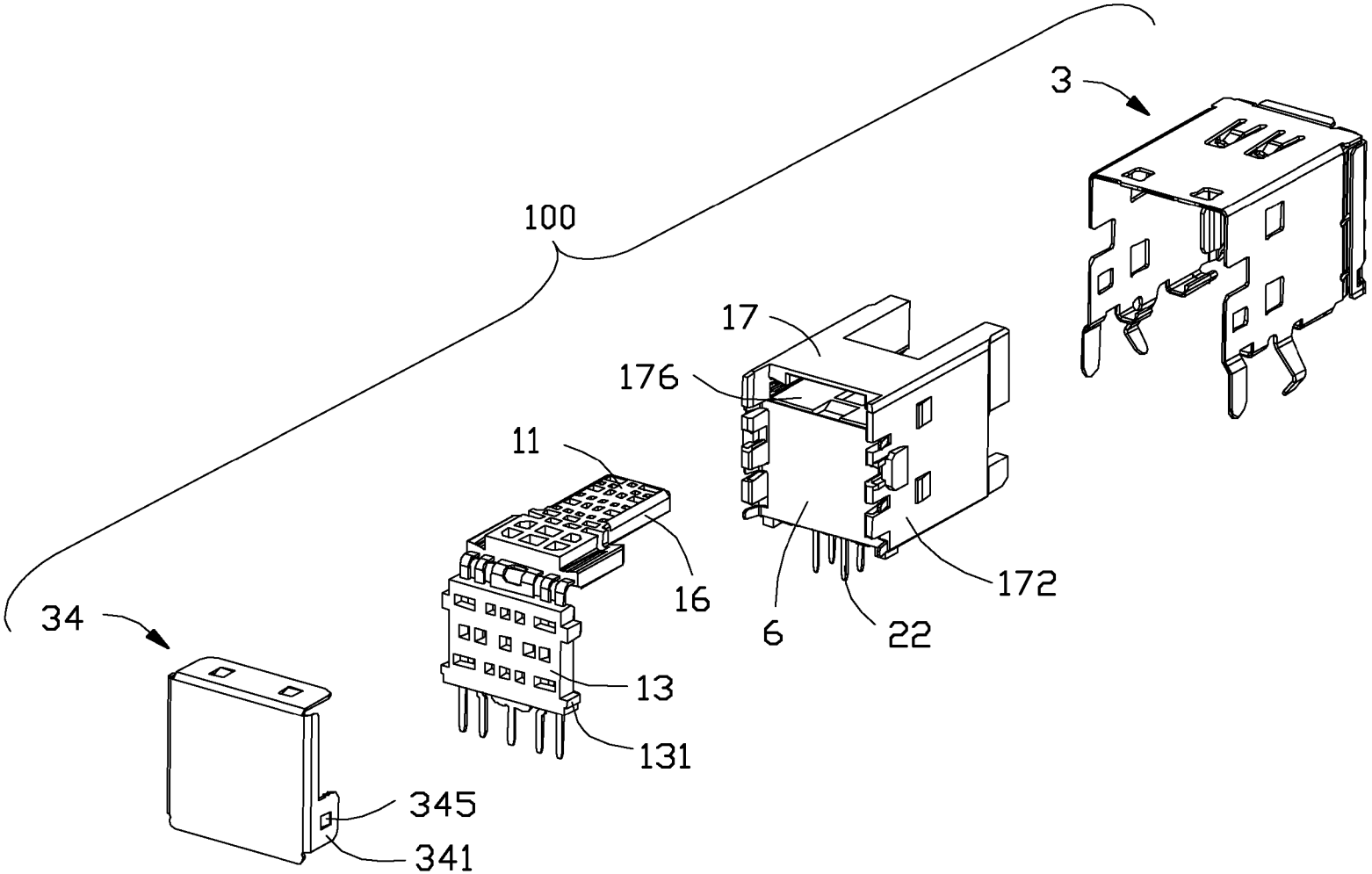
FIG. 3 is similar with FIG. 2, but taken from another side.
Figure 5:
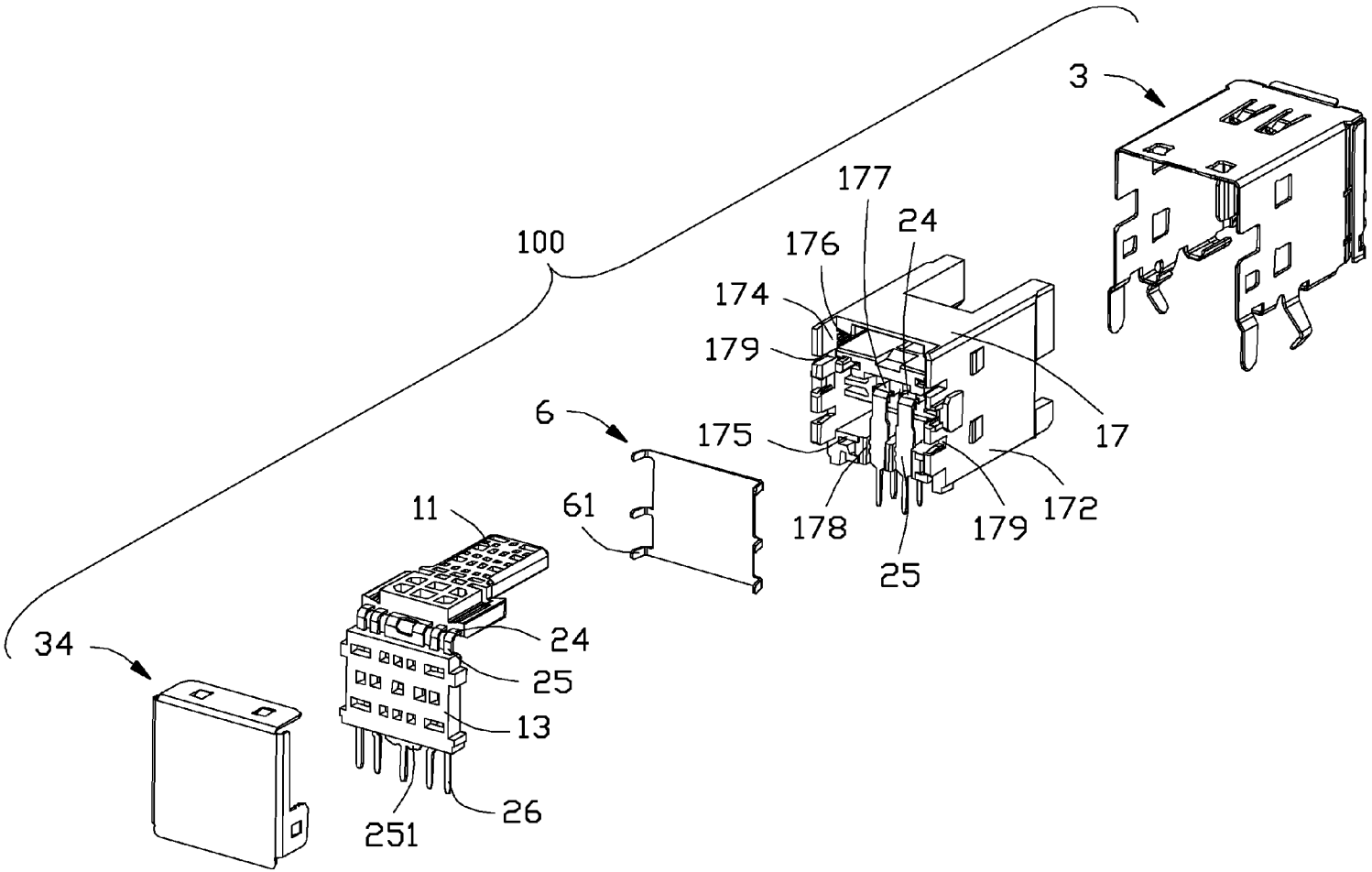
FIG. 5 is a partly exploded perspective view of the electrical connector in FIG. 1, wherein a metallic shielding plate is separated from a first terminal module and a second terminal module.
Figure 6:
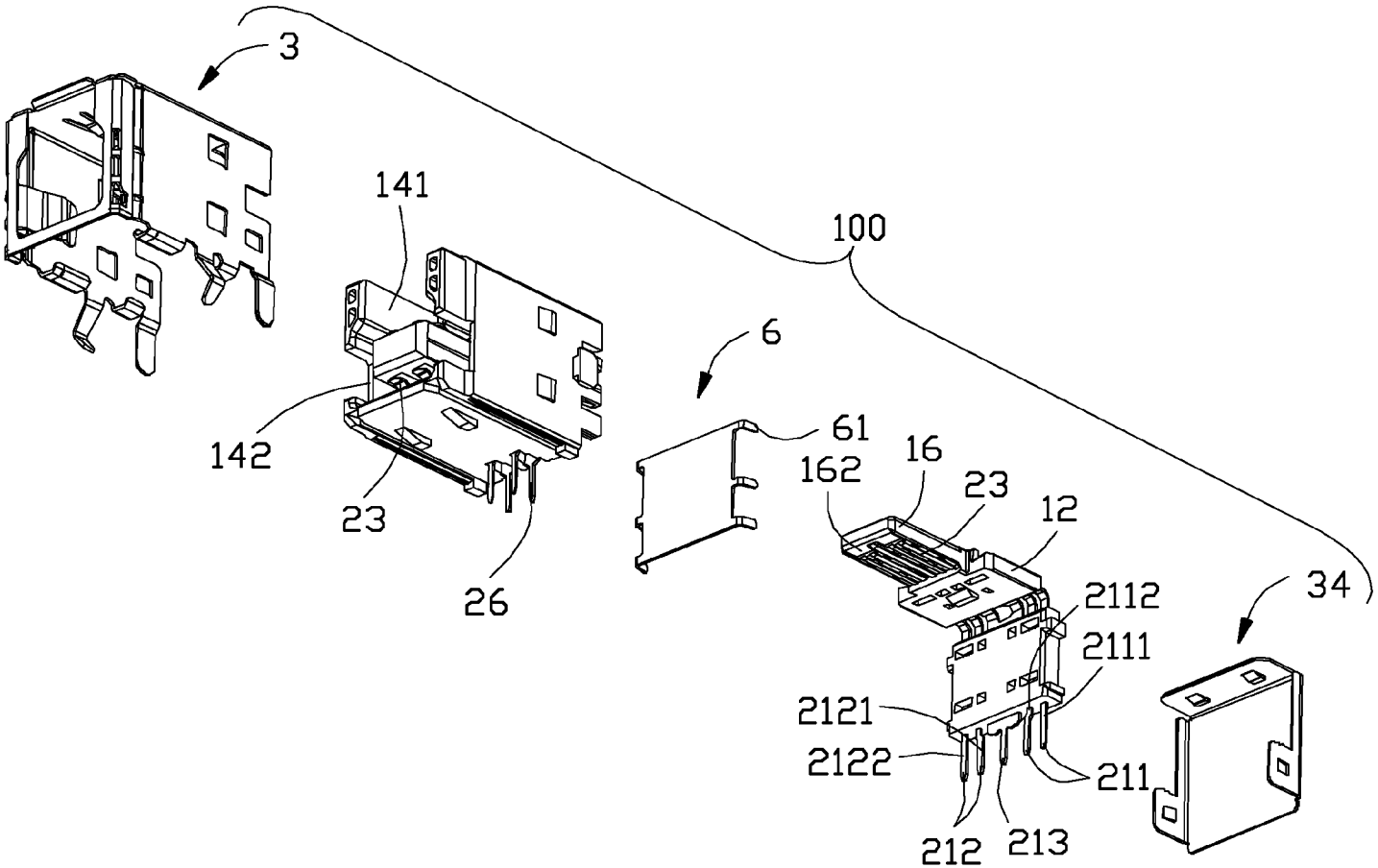
FIG. 6 is similar with FIG. 5, but taken from another side.
Figure 7:
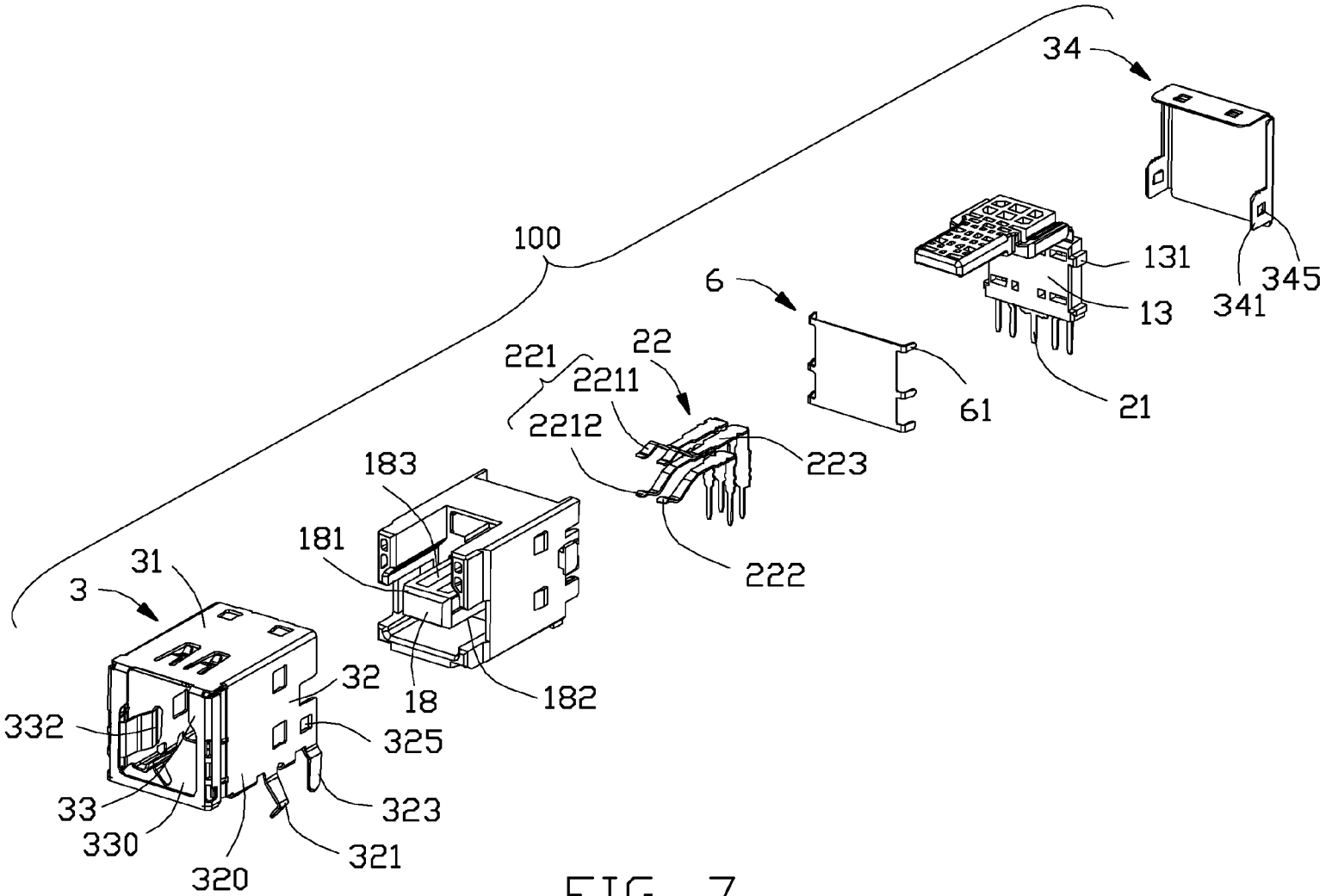
FIG. 7 is an exploded perspective view of the electrical connector in FIG. 1.
Figure 8:
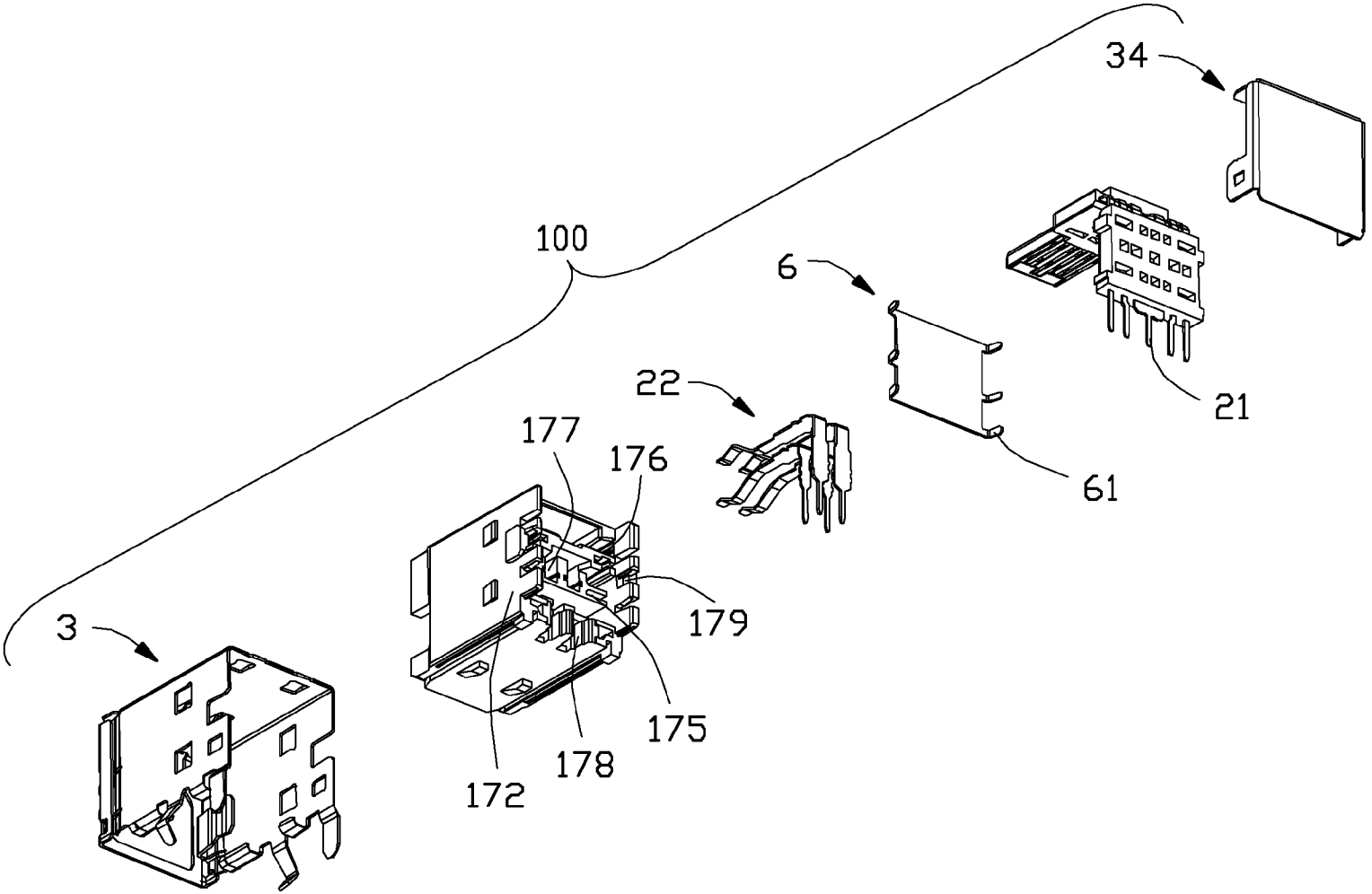
FIG. 8 is another exploded perspective view of the electrical connector in FIG. 1.

Referring to FIG. 3, FIG. 6 and FIG. 7, the insulating housing 1 has a first body portion 11, a second body portion 12 and an insulating block 13 retained in a rear end of the second body portion 12. The second body portion 12 defines a mating cavity 14 recessed from a front face thereof and being used for receiving a complementary plug. The mating cavity 14 are divided into a first receiving cavity 141 and a second receiving cavity 142 located below and communicating with the first receiving cavity 141. The first receiving cavity 141 has an opening facing external and being smaller than an opening of the second receiving cavity 142. The first body portion 11 has a first mating tongue 16 extending forwardly into the first receiving cavity 141. The second body portion 12 has a base portion 17 and a second mating tongue 18 extending into the second receiving cavity 142 from the base portion 17. The first and second mating tongues 16, 18 are parallel with each other, a thickness of the first mating tongue 16 is smaller than that of the second mating tongue 18 along a vertical direction. Combined with FIG. 5, the base portion 17 has a lower wall 171, two opposite side walls 172 disposed at two sides of the mating cavity 14, a rear wall 173 connecting with the two side walls 172 and being located at a rear side thereof, an accommodating room 174 recessed forwardly from the rear wall 173, a supporting wall 175 located in a front side of the accommodating room 174 and being parallel to the rear wall 173, a retaining slot 176 running forwardly through the base portion 17 and communicating with the first receiving cavity 141 which is used for fixing the first body portion 11, four receiving slots 177 running forwardly and rearwardly through the base portion 17 and a plurality of limiting slots 178 extending forwardly and downwardly from the supporting wall 175. The limiting slot 178 communicates with the receiving slot 177. Each side wall 172 has at least one abdicating slot 179 recessed forwardly from the rear side thereof. Referring to FIG. 7, the second mating tongue 18 has a first mating face 181 and a second mating face 182 opposite to the first mating face 181. The first and second mating faces 181, 182 separately define two recessed slots 183 extending forwardly from the receiving slots 177. The first mating tongue 16 has a third mating face 162 facing directly to the second mating tongue 18. The second body portion 12 has a plurality of mounting blocks 1710 extending downwardly from the lower wall 171 of the base portion 17. Each mounting block 1710 has a mounting face 1711 in the bottom thereof which is mounted onto a printed circuit board (not labeled).

Figure 1:
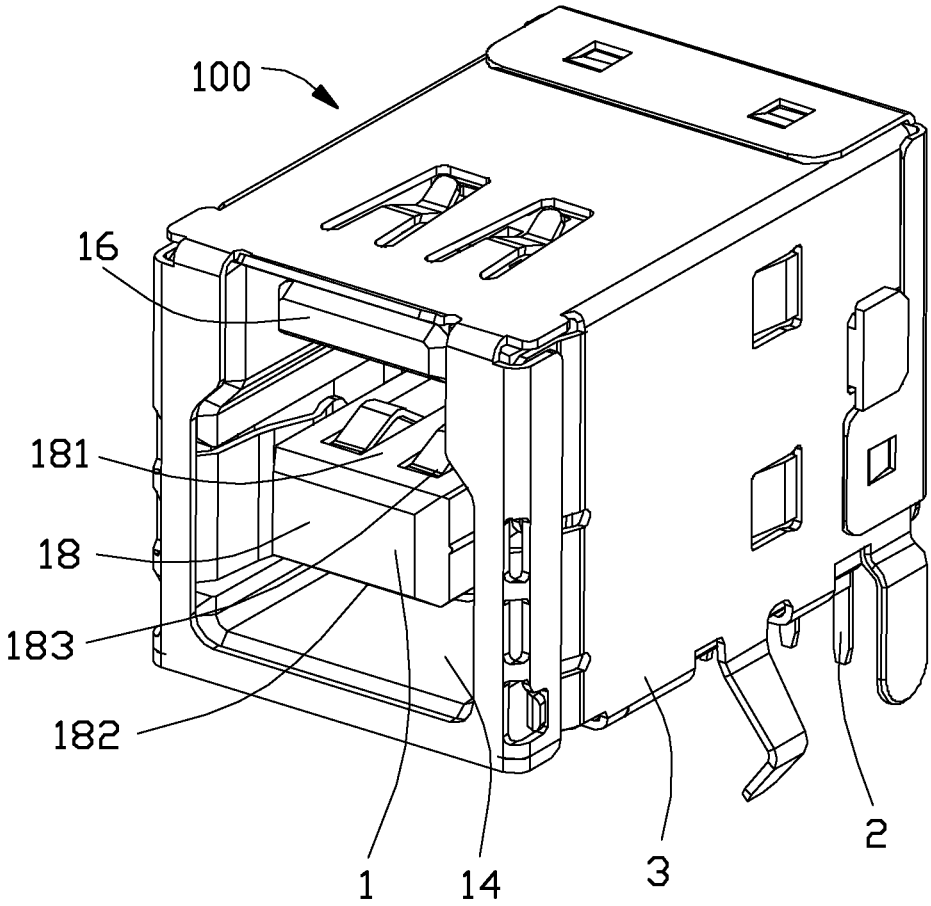
FIG. 1 is a perspective view of an electrical connector of the present invention.
Figure 2:
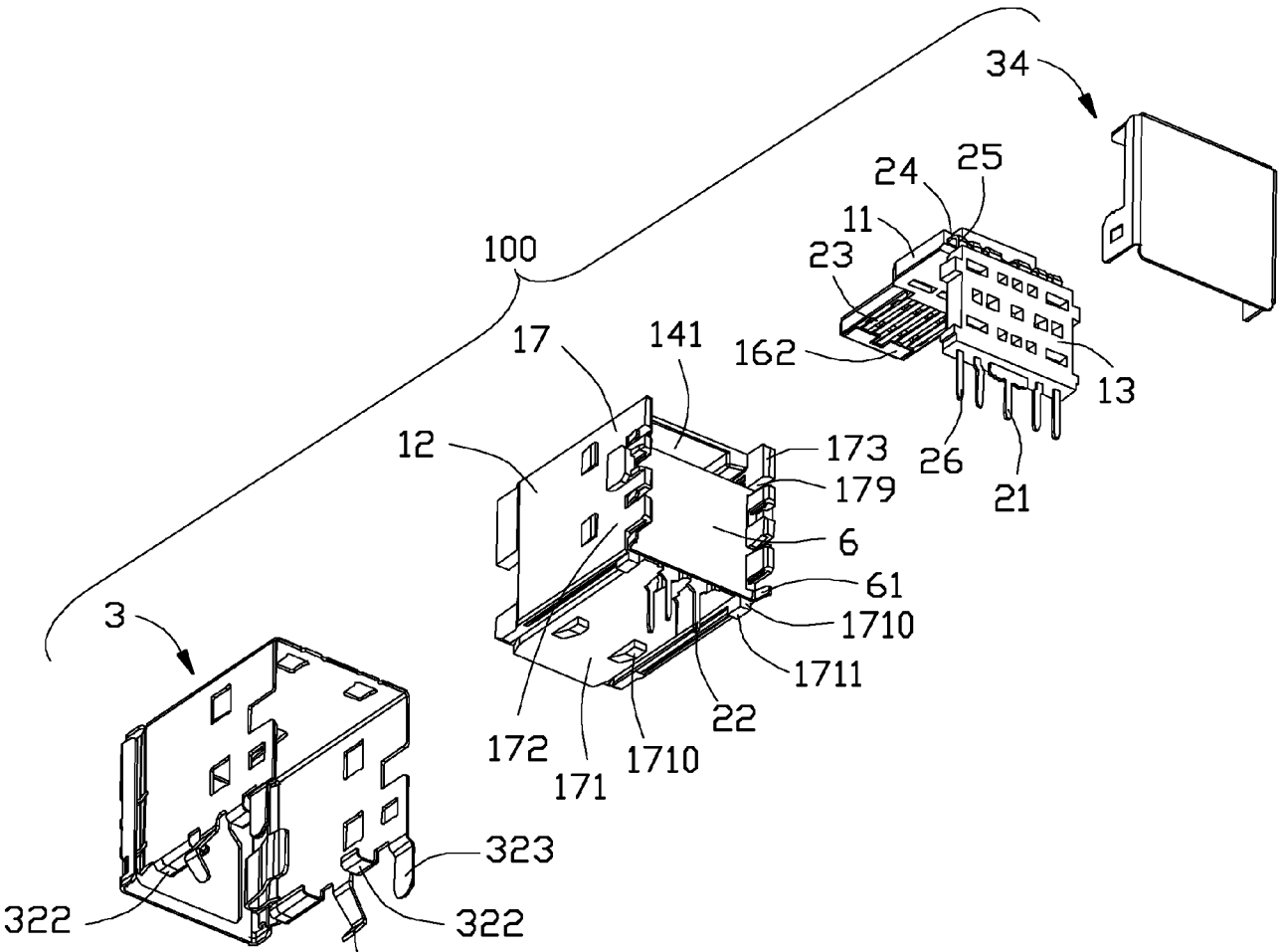
FIG. 2 is a partly exploded perspective view of the electrical connector in FIG. 1.

Referring to FIG. 2 and FIG. 5, the conductive terminals 2 comprise a plurality of first terminals 21 and a plurality of second terminals 22. The second terminals 22 are used as USB 2.0 B type receptacle connector terminals to be electrically contact with the USB 2.0 B type complementary plug. The first and second terminals 21, 22 are together used as USB 3.0 type receptacle connector terminals. Each conductive terminal 2 has a contacting section 23 located in a front side thereof, a fixing section 24 connecting with the contacting section 23, a connecting section 25 extending downwardly from the fixing section 24 in a vertical direction and a through hole type soldering section 26 extending out of the insulating housing 1 from the connecting section 25. The contacting sections 23 of the first terminals 21 are arranged in the third mating face 162 of the first mating tongue 16. The fixing sections 24 of the first terminals 21 are disposed in a same plane and insert molded in the first body portion 11. All the connecting sections 25 and the soldering sections 26 of the first terminals 21 are arranged in a same vertical plane, all the connecting sections 25 of the first terminals 21 are insert molded in the insulating block 13. All the connecting sections 25 of the first terminals 21 extend downwardly out of the lower wall 171 of the second body portion 12.

Referring to FIG. 6, five first terminals 21 are provided in the first mating tongue 16 to be a part of a first terminal module for transmitting high frequency signal. The first terminals 21 are divided into a first pair of differential signal terminals 211, a second pair of differential signal terminals 212 and a first grounding terminal 213 disposed between the two pairs of differential signal terminals 212, 213. The first pair of differential signal terminals 212 comprise a first signal terminal 2111 disposed at an external side and a second signal terminal 2112 disposed at an internal side and located between the first signal terminal 2111 and the first grounding terminal 213. The second pair of differential signal terminals 212 comprise a third signal terminal 2121 adjacent to the first grounding terminal 213 and a fourth signal terminal 2122 disposed at an external side. The structure of the first signal terminal 2111 and the fourth signal terminal 2122 are symmetrical to the central axis of the first grounding terminal 213. The structure of the second signal terminal 2112 and the third signal terminal 2121 are symmetrical to the central axis of the first grounding terminal 213. The distance between the first and the second signal terminals 2111, 2112 is same as the distance between the third and the fourth signal terminals 2121, 2122. The connecting portions 25 of the second and the third signal terminals 2112, 2121 are offset outwardly compared to the soldering sections 26 of each signal terminal 2112, 2121, thereby the distance between the connecting section 25 and the central axis of the first grounding terminal 213 is larger than the distance between the soldering section 26 and the central axis of the first grounding terminal 213. Thus, the signal transmitting rate of the electrical connector 100 is about double faster than the standard USB 3.0 connector. In the present invention, the interference between the differential signal terminals is reduced via increasing the distance between the connecting sections 25 of two pairs of differential signal terminals, thereby improving the high frequency property between pairs of differential signal terminals. The electrical connector 100 has a same I/O interface with the standard USB 3.0 B type connector.

Figure 4:
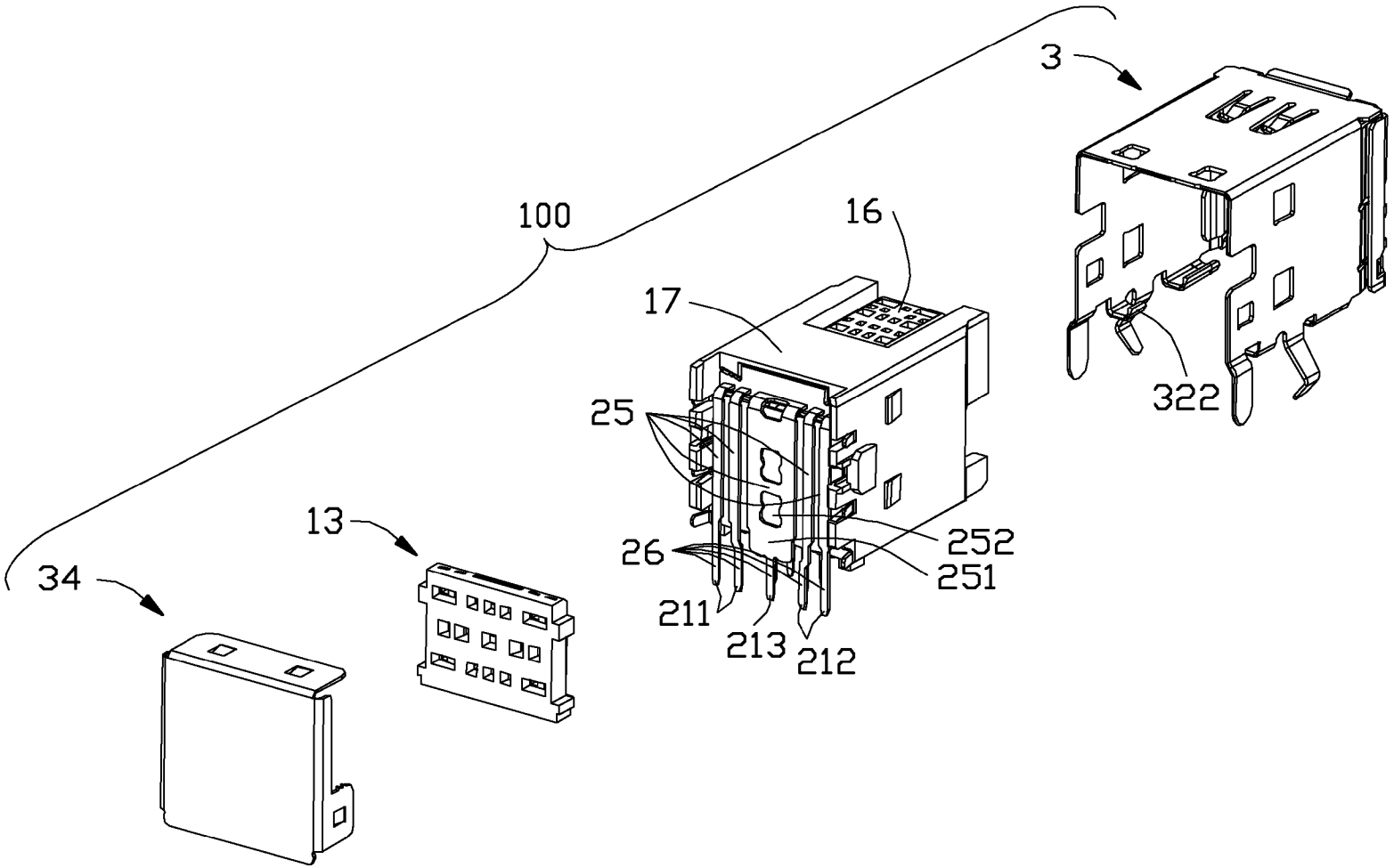
FIG. 4 is a partly exploded perspective view of the electrical connector in FIG. 1, wherein an insulating block is separated.

Referring to FIG. 4, the width of the connecting section 25 of the first grounding terminal 213 is larger than the connecting sections 25 of the first and second pairs of differential terminals 211, 212. Combined with FIG. 6, the connecting section 25 of the first grounding terminal 213 has a longer portion 251 extending downwardly out of the lower wall 121 of the insulating housing 1 therefrom. The longer portion 251 is not beyond the mounting face 1711 of the mounting block 1710. A width of the longer portion 251 is slightly smaller than the connecting section 25 of the first grounding terminal 213 along a longitudinal direction perpendicular to the vertical direction. The width of the soldering section 26 of the first ground terminal 213 is smaller than the connecting section 25 and the longer portion 251 along the longitudinal direction. The soldering section 26 extends downwardly from a middle of a bottom portion of the longer portion 251. The longer portion 251 is adjacent to the upper surface of the printed circuit board when the electrical connector 100 is mounted onto the board. Thus, it is benefit for improving the grounding effect of the grounding terminal 213 so as to prevent the interference between the differential signal terminals when transmitting high frequency signal, thereby prevent the EMI of the electrical connector 100.

Referring to FIG. 4 to FIG. 7, four second terminals 22 are provided to be a part of a second terminal module for transmitting low frequency signal. The second terminals 22 are inserted in to the second mating tongue 18 along a rear-to-front direction. The fixing sections 24 of the second terminals 22 are retained in the receiving slots 177 of the second body portion 12. The second terminals 22 comprise a third pair of differential signal terminals 221, a second grounding terminal 222 and a power terminal 223. The third pair of differential signal terminals 221 comprise a fifth signal terminal 2211 and a sixth signal terminal 2212. The fifth signal terminal 2211 and the power terminal 223 are arranged at the first mating face 181 of the second mating tongue 18, and the sixth signal terminal 2212 and the second grounding terminal 222 are arranged at the second mating face 182 of the second mating tongue 18. Wherein the fifth and sixth signal terminals 2211, 2212 are aligned with each other both along an upper to lower direction and a front to back direction. The power terminal 223 and the second grounding terminal 222 are aligned with each other both along the upper-to-lower direction and the front-to-back direction. The connecting sections 25 and the soldering sections 26 of the fifth signal terminal 2211 and the power terminal 223 are arranged in a first vertical plane. The connecting sections 25 of the sixth signal terminal 2212 and the second grounding terminal 222 are received in the limiting slots 178. The connecting sections 25 and the soldering sections 26 of the sixth signal terminal 2212 and the second grounding terminal 222 are arranged in a second vertical plane. The second vertical plane is in front of the first vertical plane. The connecting sections 25 and the soldering sections 26 of the first and second terminals 21, 22 are arranged in three vertical planes parallel to each other.

The receptacle connector 100 has a metallic shielding plate 6 disposed between the connecting sections 25 of the first terminals 21 and the connecting sections 25 of the second terminals 22. The shielding plate 6 is accommodated in the accommodating room 174 and resists on the supporting wall 175. The shielding plate 6 is fixed on the insulating housing 1 by interfering with the two side walls 172 of the insulating housing 1. The shielding plate 6 has a plurality of hooked shrapnel 61 fixed in the abdicating slots 179 and partly protruding out of the side walls 172. The hooked shrapnel 61 protrudes outwardly to contact with the shielding shell 3. The top of the shielding plate 6 is disposed below the first body portion 11. Thus, the first and the second terminals 21, 22 are separated by the shielding plate 6, thereby preventing the signal interference between the first and second terminals 21, 22.

The first body portion 11 is over molded with the contacting sections 23 of the first terminals 21, and the insulating block 13 is over molded with the connecting sections 25 of the first terminals 21, thereby reducing the production cost. Combined with FIG. 4, The first grounding terminal 213 defines at least one fixing hole 252 in the connecting section thereof, which is benefit for enhancing the bonding strength between the grounding terminal 213 and the insulating block 13. The insulating block 13 has a plurality of mounting portions 131 mounted in the abdicating slots 179.

Figure 9:
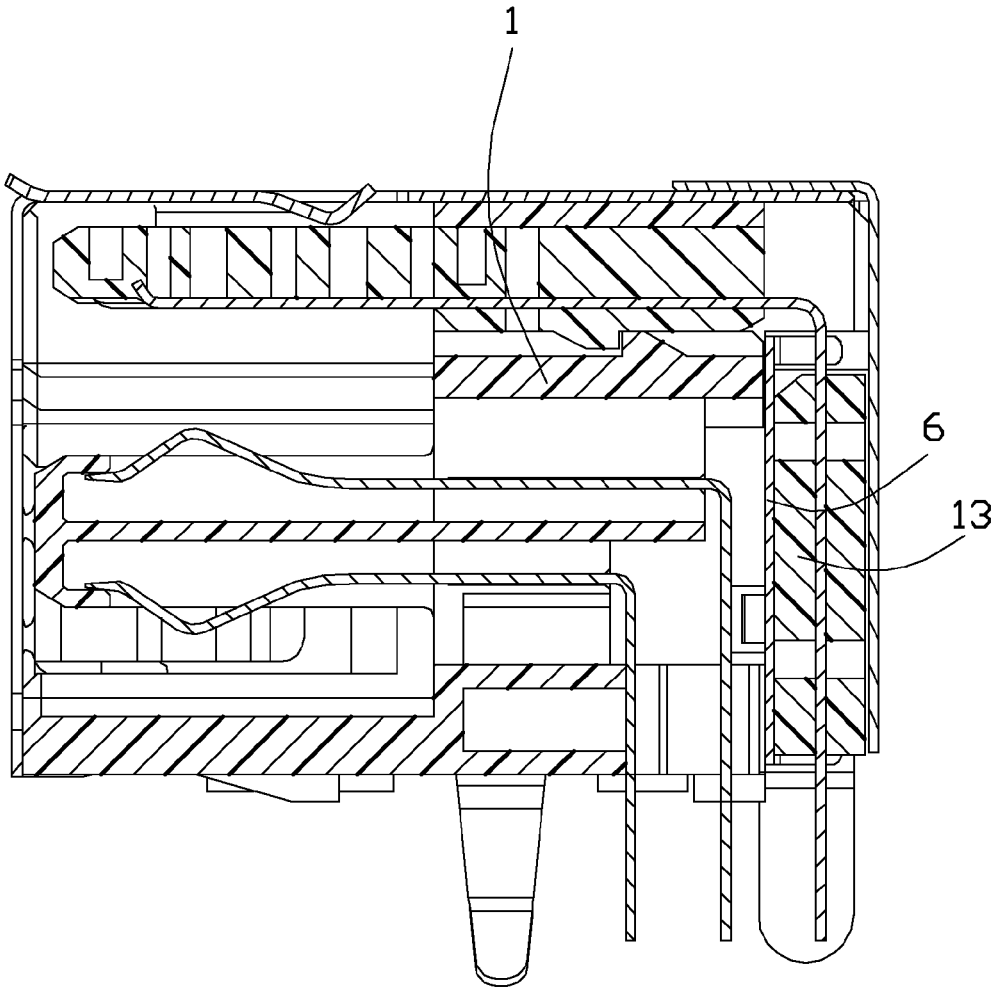
FIG. 9 is a cross-sectional view of the electrical connector of FIG. 1.

Referring to FIG. 2 and FIG. 7, the shielding shell 3 surrounds the external of the insulating housing 1 to form the aforementioned mating cavity 14. The shielding shell 3 has a top side wall 31, two opposite side walls 32, a front side wall 33 and a rear cover 34 fixed on the rear side of the two side walls 32 and shielding the rear portion of the insulating housing 1. The two side walls 32 has a first pair of retaining legs 321 extending downwardly from the middle area thereof and being used to fixed on the printed circuit board, a second pair of retaining legs 323 extending downwardly from the rear area thereof and at least one retaining plate 322 extending inwardly and latching on the bottom of the insulating housing 1. The front side wall 33 latches with the two side walls 32 at two sides. The front side wall 33 defines an opening 330 communicating with the mating cavity 14 and a shrapnel 332 extending into the mating cavity 14. The two side walls 32 have latching holes 325 in the rear area, and the rear cover 34 has two latching arms 341 extending forwardly which is provided with two latching portions 345 corresponding to the latching holes 325. The second pair of retaining legs 323 are separately disposed at two sides of the two pairs of differential signal terminals 211, 212, symmetrically, so as to reduce the signal interference between the first and second pairs of signal terminals 211, 212. FIG. 9 shows the shielding plate 6 is essentially sandwiched between housing 1 and the insulating block 13 in the front-to-back direction.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. A receptacle connector comprising:

an insulating housing having a mating cavity, the mating cavity having a first mating cavity and a second mating cavity communicating with each other, the insulating housing having a first mating tongue extending into the first mating cavity and a second mating tongue extending into the second mating cavity, the first and second mating tongues being parallel with each other, the insulating housing having a base portion located behind the mating tongue, the base portion having a lower wall, two side walls disposed at two sides of the mating cavity, a rear wall located in a rear side and connecting the two side walls and an accommodating room recessed forwardly from the rear wall, the base portion having a supporting wall located in a front of the accommodating room and being parallel to the rear wall and a plurality of terminal limiting slots recessed forwardly from the supporting wall;

a plurality of conductive terminals, the conductive terminals having a plurality of first terminals secured in the first mating tongue and a plurality of second terminals secured in the second mating tongue, each the first and second terminals both having a connecting section extending along a vertical direction;

a shielding shell surrounding the insulating housing; and a metallic plate fixed in the supporting wall, the connecting sections of the first terminals and the connecting sections of the second terminals entirely separated by the metallic plate, the side walls of the insulating housing defining abdicating slots recessed forwardly from rear sides thereof, the metallic plate formed with hooked shrapnels fixed in the abdicating slots and partly protruding out of the side walls and elastically contacting with the shielding shell, wherein the insulating housing has a first body portion received in the first mating cavity from which the first mating tongue extends forwardly into a front of the mating cavity, the metallic plate has a top portion located below the first body portion, wherein the conductive terminals have five first terminals and four second terminals, the connecting sections of the first terminals are arranged in one row, the connecting sections of the second terminals are averaged in two rows parallel with each other along a front-to-back direction.

2. The receptacle connector as claimed in claim 1, further comprises an insulating block insert molded with the connecting sections of the first terminals, the first terminals have two pairs of differential signal terminals and a grounding terminal located between the two pairs of the differential signal terminals, the width of the connecting section of the first grounding terminal is larger than each of the connecting sections of the two pairs of differential signal terminals along a longitudinal direction.

3. The receptacle connector as claimed in claim 2, wherein the base portion has at least one mounting block extending downwardly from a lower wall thereof, the mounting block has a mounting face in the bottom thereof, the connecting section of the first grounding terminal has a longer portion extending downwardly out of the lower wall, and having a width larger than the width of each of the connecting sections of the two pairs of differential signal terminals, the longer portion does not extend downwardly out of the mounting face.

4. The receptacle connector as claimed in claim 2, wherein the insulating block has a plurality of mounting portions disposed at two sides thereof and corresponding with the abdicating slots to fix the insulating housing in the accommodating room.

5. The receptacle connector as claimed in claim 4, wherein the hooked shrapnel is disposed between the mounting portion and an inner side of the abdicating slot.

6. The receptacle connector as claimed in claim 1, wherein the first mating tongue defines a first mating face facing to the second mating tongue, the second mating tongue defines a second mating face facing to the first mating face and a third mating face opposite to the second mating face, the first terminals have first contacting sections exposed in the first mating face, and the second terminals have second contacting sections separately exposed in the second and third mating faces.

7. The receptacle connector as claimed in claim 6, wherein the first mating tongue has a thinner thickness than that of the second mating tongue along a vertical direction.

8. The receptacle connector as claimed in claim 5, wherein the shielding shell has a first pair of retaining legs extending downwardly beyond a lower wall of the base portion and a second pair of retaining legs located behind the first pair of retaining legs, the second pair of retaining legs are closed to the two pairs of differential signal terminals and symmetrical with each other.

9. A receptacle connector comprising:

a first terminal module provided with a first mating tongue and a plurality of first terminals insert molded thereamong, the first mating tongue having a first mating face on which the first terminals are exposed, the first terminals having first connecting sections extending in a vertical direction and being disposed in one row along a longitudinal direction perpendicular to the vertical direction;

a second terminal module provided with a second mating tongue and a plurality of second terminals inserted therein along a rear-to-front direction, the second mating tongue having a second mating face directly facing to the first mating face and a third mating face opposite to the second mating face, the second terminals disposed in the second and the third mating faces and having second connecting sections extending in the vertical direction;

a shielding shell surrounding the first and second terminal modules to form a mating cavity opening forwardly into which the first and second mating tongues extend forwardly; and a metallic shielding plate disposed between the first and second connecting sections, the metallic shielding plate having a plurality of hooked shrapnels elastically contacting with the shielding shell;

wherein the second terminal module has a base portion from which the second mating tongue extending forwardly, the base portion has a supporting wall in a rear side thereof along the vertical direction on which the metallic shielding plate is attached on, wherein the base portion has a through hole running forwardly and rearwardly therethrough, the first terminal module is assembled into the second terminal module via the through hole so as to make the first and second mating tongues be parallel with each other, wherein the base portion has an accommodating room recessed forwardly from the rear side thereof, the first terminal module has an insulating block over molded in the first connecting sections and received in the accommodating room, the metallic shielding plate is fixed between the base portion and the insulating block.

10. The receptacle connector as claimed in claim 9, wherein five first terminals are provided in the first terminal module, the five first terminals comprise a grounding contact and two pairs of differential signal contacts disposed at two sides of the grounding contact, the connecting section of the grounding contact has a wider width than that of the connecting section of the differential signal contact.

11. The receptacle connector as claimed in claim 9, wherein the base portion has a plurality of abdicating slots recessed forwardly from two sides of the rear side thereof, and the hooked shrapnels are fixed in the abdicating slots and partly protruding out of the abdicating slots.

12. An electrical connector comprising:

an insulative housing forming opposite upper and lower mating ports in a vertical direction;

a lower mating tongue unitarily formed with the lower mating port;

a plurality of lower contacts assembled to the lower mating tongue, each of said lower contacts including a front mating section lying upon the lower mating tongue and extending along a front-to-back direction perpendicular to said vertical direction, and a rear mounting section extending downwardly along said vertical direction;

an upper mating tongue discrete from the housing while assembled to the housing and exposed within the second mating port;

a plurality of upper contacts assembled to the upper mating tongue via an insert molding process to commonly form a terminal module, each of said upper contacts including a front mating portion lying upon the upper mating tongue and extending along the front-to-back direction, and a rear mounting port extending downwardly along said vertical direction;

a metallic shell enclosing the housing; and a metallic shielding plate located between the mounting sections of the lower contacts and the mounting portions of the upper contacts in the front-to-back direction; wherein the shielding plate is fixed to the housing and mechanically and electrically connected to the shell, wherein said lower contacts are forwardly inserted into corresponding passageways of the housing along said front-to-back direction before the shielding plate is assembled to a rear side of the housing, wherein the shielding plate and the hosing are configured to allow the shielding plate to be forwardly assembled to the housing along only said front-to-back direction.

13. The electrical connector as claimed in claim 12, wherein said terminal module and said housing are configured to allow said terminal module to be forwardly assembled into the housing along only said front-to-back direction and after said shielding plate is assembled to the housing.

14. The electrical connector as claimed in claim 13, wherein said shielding plate is essentially sandwiched between the terminal module and the housing in the front-to-back direction.

* * * * *